United States Patent [19]

Jones et al.

[11] 4,313,970

[45] Feb. 2, 1982

[54] METHOD OF MASKING A WORKPIECE FOR PAINTING

[75] Inventors: Wallace R. Jones, Waite Hill Village; John F. Haas, Chagrin Falls; Paul A. Krieger, Bay Village; David E. Frappier, Mayfield Height, all of Ohio

[73] Assignee: The Excello Speciality Company, Cleveland, Ohio

[21] Appl. No.: 165,616

[22] Filed: Jul. 3, 1980

[51] Int. Cl.[3] ..... B05D 3/06

[52] U.S. Cl. ..... 427/56.1; 427/208.4; 427/236; 427/282; 427/422

[58] Field of Search ..... 427/56.1, 208.4, 236, 427/282, 422

*Primary Examiner*—Bernard D. Pianalto

*Attorney, Agent, or Firm*—Fay & Sharpe

[57] ABSTRACT

A method of masking a workpiece at a demarcation zone to facilitate precise spray painting of a workpiece first area on one side of the zone. The method includes providing a mask which has an adhesive backing on one face thereof and a protective liner removably secured to the adhesive backing. The liner is cut or severed so that the resultant sever line has the same conformation therealong as that desired for the demarcation zone. That section of liner associated with the portion of the mask to be affixed to a workpiece second area on the opposite side of the demarcation zone from the workpiece first area is removed from the mask. Thereafter, the mask may be affixed to have the liner sever line precisely aligned with the demarcation zone. Pressure is exerted against the mask at a thin pressure zone coextensive with the demarcation zone to automatically lift that portion of the mask which overlaps the workpiece first portion at and along the demarcation zone to generally form an acute angle therewith. The workpiece first area may then be spray painted from a direction generally normal to the workpiece plane at least adjacent the demarcation zone. The pocket-like area of the mask causes the paint to be feathered toward the demarcation zone and thereby enhance blending of the painted areas precisely along that zone. A paint drape may also be accommodated by and affixed to the mask to protect a larger portion of the workpiece second portion. An alternative construction for the mask employs a thin vinyl sheet material with heat being subsequently applied to effect lifting.

22 Claims, 10 Drawing Figures

METHOD OF MASKING A WORKPIECE FOR PAINTING

BACKGROUND OF THE INVENTION

This invention pertains to the art of painting and more particularly to spray painting a predetermined or preselected area of a workpiece.

The invention is particularly applicable to a method of masking a workpiece in preparation for such spray painting along some demarcation zone and will be described with particular reference thereto. However, it will be appreciated by those skilled in the art that the invention has broader applications and may be adapted to use in other painting environments and applications.

In many industries, it is desired to spray paint finished products and the like so that they will be of one color or tone on one side of some predetermined demarcation zone and of another color or tone on the other side of the demarcation zone. This type of finish painting is often associated with the automobile and appliance industries, although it is utilized elsewhere for other products and product lines. In addition, demarcation zones are present in so-called refinish painting work and in painting work performed subsequent to some product or workpiece surface repair. In order to obtain satisfactory or aesthetically pleasing results, it is necessary to mask the product at least along the demarcation zone to prevent paint overspray onto adjacent areas of the product which are not to be painted.

Various paint masking systems have been known in the art for many years and include, for example, use of conventional masking type tape or the like. In the most basic of these prior systems, the masking tape is affixed to the workpiece with one tape side edge disposed coextensive with the demarcation zone. This then separates that portion of the workpiece surface which is to be painted from that portion which is not to be painted. Moreover, the tape is also typically used to retain paint drapes of paper, cloth or the like in position over at least that section of the workpiece portion to be protected adjacent to the demarcation zone.

One particular drawback to this type of general masking system is that when the tape and other mask materials are removed from the workpiece following painting, a distinct paint ridge is defined along the demarcation zone. Thus, it is necessary to utilize further finishing steps to remove or blend the ridge into the remainder of the workpiece finish. Other problems with these prior masking systems reside in the extremely cumbersome installation procedures required and the close correlation between the overall success of the mask and the ability and/or experience of the mask installer. Still further, the final painting costs are increased because of the necessity for performing separate finishing steps for removing or blending the paint ridge at the demarcation zone.

Through the years, many attempts have been made at improving the aforementioned general type of paint mask system for reducing or entirely eliminating the problems generally associated therewith. All of these various improved systems have, however, still had associated problems during application and use. Consequently, entirely satisfactory mask installation and painting results could not be reliably achieved. Moreover, such systems oftentimes still necessitated some type of finishing work at the demarcation zone following painting and mask removal.

By way of specific example, one improved mask arrangement is shown and described in U.S. Pat. No. 3,930,069 to Stephens. The system there disclosed utilizes a non-metallic protective tape which includes an adhesive backing over a portion of one face thereof and applied in a manner such that the tape face has a straight longitudinal junction line therealong defining the adhesive backed portion from a non-adhesive backed portion. The tape is applied to a workpiece so that the longitudinal junction line between the adhesive and non-adhesive areas corresponds to a predetermined demarcation zone with the non-adhesive area extending over a portion of the workpiece area which is to be painted. Thereafter, the non-adhesive backed portion of the tape is manually bent away from the workpiece so as to define a tapered, outwardly opening pocket diverging from the workpiece. Paint is then sprayed onto that portion of the workpiece which is to be painted and into the pocket area defined by the mask. Paint applied within the pocket is feathered toward and terminates at the demarcation zone. A last or final coating of solvent is sprayed or otherwise applied to the paint to feather it along the demarcation zone to a minimum thickness in an effort to achieve blending with the adjacent painted area. Following mask removal, any paint ridge or edge line remaining along the demarcation zone is removed or rubbed out through use of a suitable rubbing compound.

While the method and arrangement disclosed in U.S. Pat. No. 3,930,069 has found some commercial success, it too has several drawbacks. For example, the protective tape is only viably useful for demarcation zones or break line areas which have generally straight line configurations. Demarcation zones or break line areas which are curvilinear or are otherwise unusually configured are very difficult to mask using this system. Indeed, in such situations, the ability and experience of the person applying the mask again plays a very significant role in determining the overall aesthetic success of the final paint finish obtained.

Further, in manually bending the non-adhesive backed portion of the tape from association with the workpiece, the inherent resiliency or memory of the tape will oftentimes cause that tape portion to drift back toward engagement with the workpiece. Thus, the mask requires close monitoring during the painting process with continual manual rebending of the non-adhesive backed tape portion. Variations in the amount of such bending can also affect the overall surface finish obtained adjacent the demarcation zone and cause undesired variations therein. In addition, some final finishing steps following mask removal are required to obtain satisfactory blending and/or removal of a paint ridge created along the demarcation zone. The reason such further steps are needed is due simply to the basic construction of the tape and its cooperative relationship with the workpiece. That is, the interface or junction between the adhesive backed and non-adhesive backed portions of the tape provide a natural ledge area along the demarcation zone to thus allow paint accumulation and create the undesired paint ridge.

It has, therefore, been considered desirable to provide a further improved method for masking which would overcome the foregoing practical problems encountered in using previously known masking methods and techniques. The subject invention is deemed to meet these needs as well as others. The invention provides a new and improved method of masking a workpiece which is simple, effective, accommodates masking along demarcation zones which have many different configurations, provides an acceptable finish at the demarcation zone requiring no further finishing steps and is readily adapted for use in a wide variety of applications.

BRIEF DESCRIPTION OF THE INVENTION

The subject invention focuses on a new and improved method for masking to facilitate painting of a workpiece first area along some predetermined demarcation zone extending between or defining workpiece first and second areas. In practicing the inventive concepts involved, a particular mask arrangement having an adhesive backing on one face thereof and a removable liner covering the adhesive backing is advantageously employed. The mask is adhesively secured to the workpiece second area in a particular manner which accommodates achievement of the desired painting results.

More particularly, the invention contemplates severing or cutting the liner in a manner defining a continuous sever line conforming to the demarcation zone and which divides the mask into at least two distinct sections. One of the mask sections is adapted to be associated with the workpiece first area and the other of the sections is adapted to be associated with the workpiece second area. The liner associated with the mask second section is first stripped from the mask so as to expose the adhesive thereunder. Next, the mask second section is adhesively secured to the workpiece second area with the continuous sever line aligned to substantially correspond with the desired demarcation zone and with the mask first section extending from the demarcation zone over an area of the workpiece first area. Thereafter, a pressure force is exerted against the mask second section along a pressure zone coextensive with and adjacent to the demarcation zone. This pressure causes the mask first section to automatically lift away from the workpiece first area along the sever line and assume a generally set position. In this set position, the mask first section extends outwardly from the demarcation zone at generally an acute angle with the workpiece first area so as to prevent any interference during subsequent spray painting of the workpiece first area.

In accordance with the preferred steps of the method, severing of the liner is advantageously effected by means of scoring or die cutting.

According to a further aspect of the invention, the pressure force is exerted by a pressure tool which is pressed against the mask at the pressure zone. In the preferred arrangement, a hand tool constructed from a plastic material is employed and is simply moved from one end of the pressure zone toward the other.

According to another aspect of the invention, a paint drape is affixed to the mask second section adajcent the edge thereof opposite from said mask first section in order to protect a larger area of the workpiece second area during painting. In one preferred form, the drape is affixed to the mask second area simultaneous with the step of stripping the liner therefrom.

In accordance with a more limited aspect of the invention, the mask is constructed from material which, when exposed to heat, will automatically cause the mask first section to be lifted or curled away from the workpiece first area. Preferably, such heating is effected by placing a heat source such as a heat lamp and at least the mask first section in predetermined heating proximity with each other. In this alternative form for practicing the invention, the mask is comprised of a thin vinyl material.

In accordance with still a further aspect of the invention, the overall method includes spray painting the workpiece first area following installation of the mask and thereafter removing the mask from association with the workpiece. Spray painting is effected from a direction generally normal to the workpiece first area and is not focused directly into the mask pocket area. Mask removal may be accomplished either while the paint is still wet or following some predetermined drying time.

The principal object of the present invention is the provision of a new and improved method of masking a workpiece for painting.

Another object of the invention is the provision of such a new and improved method which is simple and easy to use for obtaining reliable painting results along some predetermined demarcation zone.

Still another object of the invention is the provision of a method of masking a workpiece which may readily accommodate any number of varied demarcation zone configurations.

A further object of the invention resides in a method of masking a workpiece which facilitates obtaining an acceptable paint finish having appropriate feathered characteristics at the demarcation zone without the requirement for additional finishing steps.

Still other objects and advantages of the invention will become readily apparent to those skilled in the art upon a reading and understanding of the following specification.

BRIEF DESCRIPTION OF THE DRAWINGS

The invention may take physical form in certain parts and arrangements of parts, preferred and alternative embodiments of which will be described in detail in this specification and illustrated in the accompanying drawings which form a part hereof and wherein.

DETAILED DESCRIPTION OF PREFERRED AND ALTERNATIVE EMBODIMENTS

Figure 1:
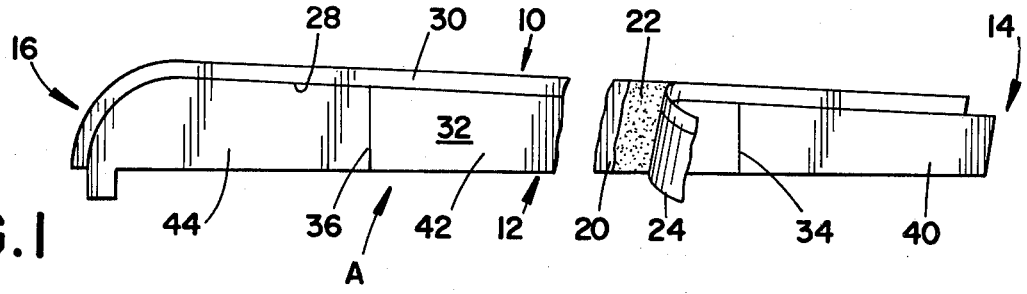
FIG. 1 is a plan view of a paint mask which allows successful practice of the subject new and improved method wherein a portion of the mask liner has been pulled back and a portion of the adhesive broken away for ease of illustration.

Referring now to the drawings wherein the showings are for purposes of illustrating preferred and alternative embodiments of the invention only and not for purposes of limiting same, FIG. 1 shows a paint mask A designed and constructed to facilitate successful practice of the subject new and improved method.

More particularly, mask A includes a pair of elongated spaced apart side edges 10,12 and a pair of spaced apart end areas 14,16. The particular conformation of the mask is for a particular workpiece in order to accommodate a particularly desired painting result. It will be appreciated, however, that many other mask configurations and styles may and will be advantageously utilized in practicing the invention. For example, the mask may take a roll form and be constructed to have a texture similar to that of conventional masking tape. Mask A of FIG. 1 is designed for particular use in painting a portion of an automobile body and, as will be described, demonstrates the versatility of the method where a desired demarcation zone is curved or otherwise irregular in configuration.

The mask itself is comprised of a laminated type structure having a thin flexible mask layer 20, an adhesive layer 22 covering the entirety of one face of the mask layer and a liner 24 removably received and retained by the adhesive layer. In the preferred arrangement, mask layer 20 is constructed from a thin paper or paper-like material for purposes of obtaining the best overall results as will become apparent hereinafter. Adhesive layer 22 is comprised of an acrylic type adhesive and liner 24 comprises a paper material which includes a polyethylene coating on at least the face thereof which contacts adhesive layer 22. By way of example only, mask layer 20 may have a thickness of approximately 3 or 4 mils and the liner may be constructed from a 60 lb. paper or the like. It will be appreciated, however, that other mask construction details could be utilized without in any way departing from the overall intent or scope of the invention. Mask A which is comprised of the mask layer, adhesive layer and liner may be advantageously provided in large rolls and the like with the individual masks then being die cut or scored therefrom. The specifics of such die cutting and scoring are generally known in the art and do not, in and of themselves, form a part of the present invention.

With continued reference to FIG. 1, mask A includes a continuous sever line 28 through liner 24 with this sever line extending between end areas 14,16 adjacent side edge 10. This sever line acts to divide the mask into a first section 30 and a second section 32. In the preferred arrangement, the width of first section 30 is generally no greater than ¼" wide and is typically on the order of magnitude of 3/16". The sever line through the liner thus allows the liner portions associated with the mask first and second sections 30,32 to be removed from the mask independently of each other. Sever line 28 may advantageously be provided by means of die cutting to facilitate mass production of a wide range of different masks wherein the sever lines of each mask design may be precisely located and configured so as to correspond to a desired workpiece demarcation zone. Also, die cutting allows curvilinear and other demarcation zone configurations to be readily accommodated. However, for some types and styles of masks, scoring may be utilized to obtain the sever lines.

As is also shown in FIG. 1, mask second section 32 includes a plurality of additional sever lines generally designated 34,36. These sever lines also extend through the liner and, in the particular mask shown, are disposed generally normal to sever line 28. Sever lines 34,36 thus divide mask second section 32 into plural second section segments generally designated 38,40 and 42. These additional sever lines facilitate ease of liner removal from mask second section 32 and subsequent mask installation on a workpiece as will hereinafter be described. The number and placement of sever lines similar to lines 34,36 may be varied as deemed necessary and/or appropriate for a particular mask construction and workpiece conformation.

Figure 2:
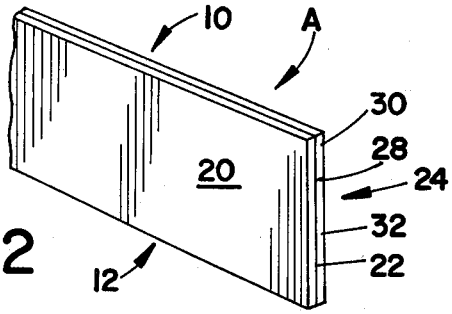
FIG. 2 is a schematic perspective view of a portion of the paint mask of FIG. 1.
Figure 3:
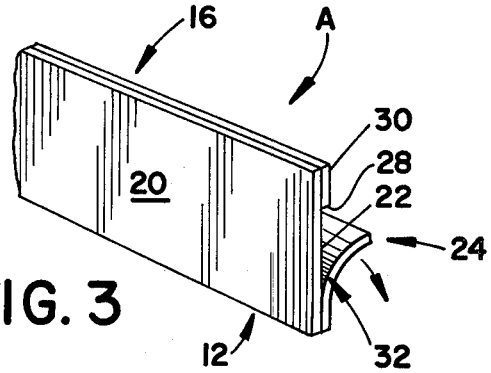
FIG. 3 is a view similar to FIG. 2 showing a portion of the mask liner being removed.

Referring now to FIGS. 2–7, description will hereinafter be made to the preferred method of use of the mask shown and constructed in the manner described. FIG. 2 is a perspective and somewhat schematic view of the mask just prior to installation showing mask layer 20, adhesive layer 22 and liner 24 wherein sever line 28 effectively divides the mask into first and second sections 30,32. In FIG. 3, that portion of liner 24 which is associated with mask second section 32 is peeled away or removed from mask A as shown by the arrow in that view. This then exposes that portion of adhesive layer 22 which is normally covered thereby.

Figure 4:
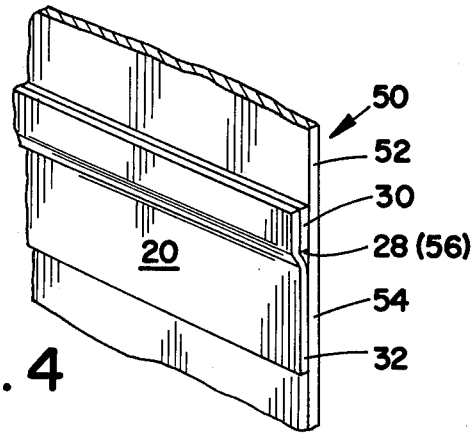
FIG. 4 is a view similar to FIG. 3 showing the mask as installed on a workpiece.

In FIG. 4, the mask is shown as being affixed to a workpiece generally designated 50. This workpiece includes a first area 52 which is to be spray painted and a second area 54 which is to be protected from such painting. First and second workpiece areas 52,54 are themselves separated by some predetermined and precise demarcation zone 56. The longitudinal configuration of this zone is, of course, known prior to construction of the overall mask A and sever line 28 is configured to be identical with the longitudinal configuration or extent of demarcation zone 56. Mask second section 32 is adhesively secured to workpiece second area 54 so that sever line 28 is placed directly over and coextensive with the workpiece demarcation zone. It is to be noted that the portion of liner 24 associated with the mask first section 30 is not removed from association with the mask.

Figure 5:
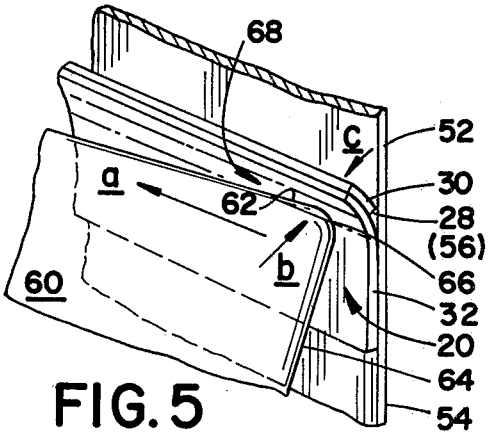
FIG. 5 is a view similar to FIG. 4 showing the application of pressure to the mask along a pressure zone.

Following installation of the mask on the workpiece, and as shown in FIG. 5, means are employed to exert a pressure force along a pressure zone on the mask. In practicing the preferred method, this means comprises a hand tool generally designated 60. The tool is constructed from a relatively hard plastic or rubber-like material and is configured to have a pair of thin side edges 62,64 which intersect at an arcuate or curvilinear nose-like area 66. The pressure zone itself is generally designated by numeral 68 and comprises a thin, imaginary band extending adjacent to and longitudinally coextensive with demarcation zone 56 on that portion of mask layer 20 which comprises mask second section 32. In other words, pressure zone 68 is located on the opposite side of mask layer 20 from sever line 28 and laterally adjacent the sever line on mask second section 32. Preferably, the pressure zone is very closely spaced toward the sever line in order to effect lifting in the most efficient manner.

As at least a portion of the tool side edge 62 adjacent nose 66 is moved along pressure zone 68 in direction a with an inward pressure into the mask generally in direction b, mask first section 30 is automatically lifted or curled away from workpiece first area generally in direction c. The pressure force thus applied causes a rearrangement or contraction of fibers in the preferred paper or paper-like construction of mask layer 20. The lifted position shown in FIG. 5 is desirably set or substantially permanent and thus prevents or eliminates the necessity for relifting first section 30 in the event actual painting is not performed until some later, delayed point in time. Moreover, the amount of such lifting in direction c is substantially constant over the entire length of mask first section 30. This feature is desirable for obtaining a consistent paint finish along the demarcation zone length.

As shown, mask first section 30 defines a generally acute angle with workpiece first area 52 so that the mask first section diverges outwardly in a pocket-like defining manner from workpiece demarcation zone 56. That is, following the above described pressure applying step, the entirety of workpiece first area 52 is accessible for painting precisely from and along workpiece demarcation zone 56. Moreover, that portion of liner 24 which remains associated with mask first section 30 advantageously provides a smooth transition between the mask and workpiece at demarcation zone 56. That is, because mask first section 30 is slightly thicker than second section 32 when the mask is installed on the workpiece, the pocket-like area will extend into actual engagement with the workpiece at the demarcation zone. Thus, the pocket-like area feathers into workpiece engagement and presents no ledge area which would otherwise allow paint accumulation.

Figure 6:
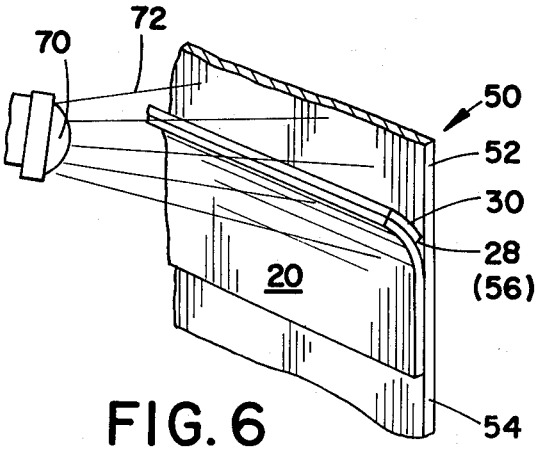
FIG. 6 is a view similar to FIG. 5 showing spray painting of the workpiece.

Thereafter, and as shown in FIG. 6, workpiece first area 52 may be spray painted. In the FIGURE, a spray painting nozzle 70 is schematically shown with the actual paint spray issuing therefrom being designated 72. The nozzle is preferrably and desirably positioned and/or focused so that paint issuing therefrom will travel in a direction generally normal to workpiece first area 52. Thus, no paint is sprayed directly into the pocket-like area defined between mask first section 30 and workpiece first area 52. Rather, a portion of the paint spray simply migrates into the pocket-like area during the course of painting the remainder of the workpiece first area. Mask second section 32 protects workpiece second area 54 to prevent any paint overspray from being received thereon. This protection is precisely coextensive with workpiece demarcation zone 56.

Figure 7:
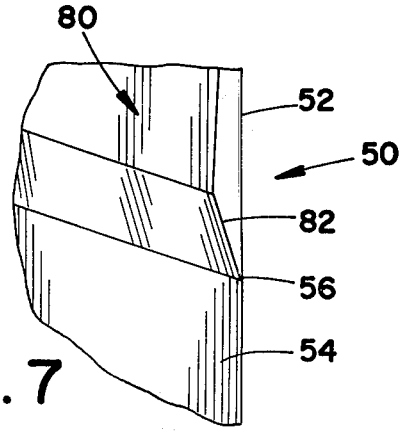
FIG. 7 is a perspective view showing the workpiece following painting and removal of the mask therefrom.

Following painting, the entire mask is removed from cooperative association with workpiece 50 and the resultant configuration of paint finish 80 is schematically shown in FIG. 7. As will be noted, this paint finish includes a feathered area 82 decreasing in mil thickness over its lateral extent toward demarcation zone 56. This feathering is a result of the presence of the mask pocket-like area coupled, in part, with the prevention of direct spray painting into that area. Mask removal itself may be accomplished immediately upon completion of painting or following various time intervals thereafter. It has been found that the precise time of mask removal does not affect the painting results obtained or cause any so-called stringing in feathered paint area 82. It has also been found that when utilizing the subject method as described in detail hereinabove, no additional finishing steps are required to be performed at demarcation zone 56 for purposes of, for example, removing or blending a paint ridge.

Figure 8:
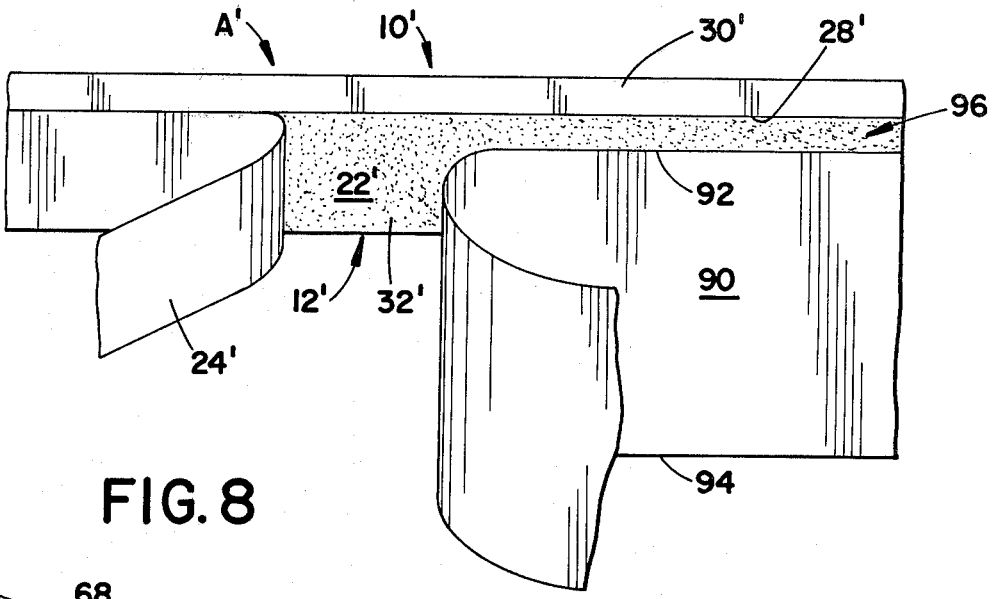
FIG. 8 is a view similar to FIG. 1 showing a mask construction which includes a paint drape for practicing the subject new method.

FIG. 8 is in the same direction as FIG. 1 and shows a slightly modified mask arrangement which employs the concepts of the subject invention. For ease of appreciation and illustration of this modification, like components are identified by like numerals with a primed (') suffix and new components are identified by new numerals.

In this FIGURE, a paint drape generally designated 90 is also advantageously provided. While this drape may be constructed from any number of different materials, use of a thin paper material is generally contemplated. Drape 90 has a longitudinal side edge 92 which is at least substantially compatible with the longitudinal conformation of mask sever line 28'. A second side edge 94 is generally laterally spaced from edge 92 some predetermined distance so as to drape or cover a predetermined portion of a workpiece second area when the mask has been installed. It should be noted that drape side edge 92 is laterally spaced from sever line 28' so as to define a narrow band 96 of the adhesive. The overall mask and drape construction is thus retained in position on a workpiece by adhesive band 96.

Particularly in the case where mask A' takes the form of a roll or the like where side edges 10',12' thereof are parallel to each other, drape 90 may be automatically applied simultaneous with removal of that portion of backing 24' which initially covers mask second section 32'. Machines or apparatus (not shown) are available for automatically removing backing 24' and such apparatus may be slightly modified to accommodate simultaneous affixing of the drape with side edge 92 thereof properly spaced from and aligned relative to sever line 28'. In this case, the drape is normally supplied in roll form and simply unrolled and applied to the mask as the mask is passed through the apparatus for stripping of that section of backing 24' associated with mask second section 32'. As such a machine or apparatus does not itself comprise a part of the present invention and since acceptable apparatus for this purpose are generally known to those skilled in the art, a detailed description thereof is deemed unnecessary.

Of course, the drape may be affixed to the mask by hand and/or the drape may be configured to accommodate special mask conformations such as shown in FIG. 1. Typically, and whether drape 90 is automatically or hand applied, the width of band 96 will be in the range of $\frac{1}{4}''$ or so. However, other widths may be used as deemed necessary and appropriate to meet different masking circumstances.

Figure 9:
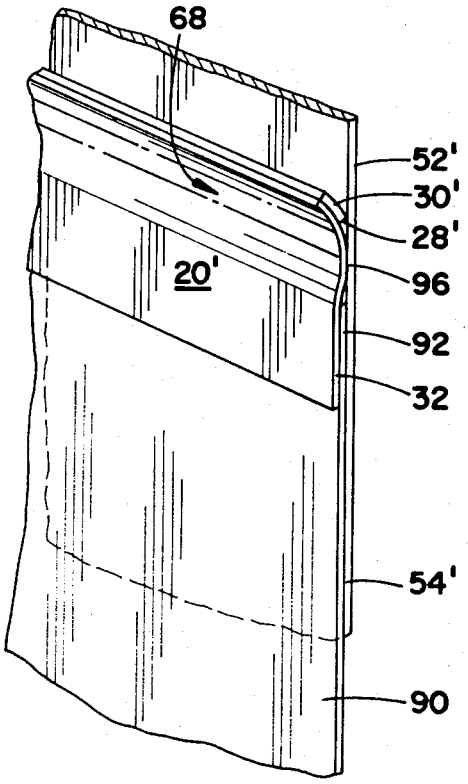
FIG. 9 shows a perspective view of the mask of FIG. 8 in its installed position similar to FIG. 5; and, FIG. 10 shows a perspective view similar to FIG. 5 showing the application of heat to an alternative construction for the mask.

FIG. 9 is a partial perspective view showing the mask and drape arrangement of FIG. 8 as it has been installed on a workpiece by adhesive band 96 and a pressure force exerted along pressure zone 68' to lift mask first section 30' away from workpiece first area 52'. As will be noted, drape 90 covers a much larger portion of workpiece second area 54' and thus protects the workpiece from overspray and splatter during the painting step.

Figure 10:
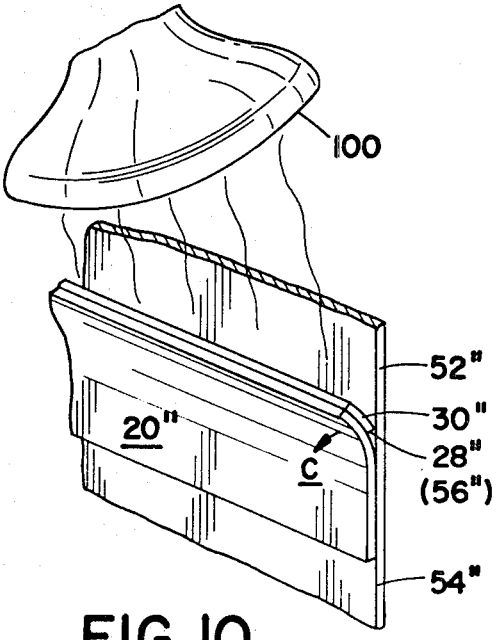

FIG. 10 shows a modified form of the mask which is constructed from different materials and treated by different means to obtain lifting of the mask first section from the workpiece first area. Here, like components are identified by like numerals with a double primed (") suffix and new components are identified by new numerals. The view of FIG. 10 takes the place of FIG. 5 in the method described hereinabove with the remaining method step being the same as shown and described above with reference to FIGS. 2–4, 6 and 7.

More particularly, mask layer 20" is constructed from a thin vinyl material which is preferably black in color for purposes of obtaining the best overall results. The mask layer has a preferred thickness of approximately 3 or 4 mils. The adhesive layer and liner are, in turn, substantially as previously described.

Following installation of the mask on the workpiece in the manner shown in, for example, FIG. 4, at least mask first section 30″ is exposed to elevated temperatures. In practicing the subject new method with this modified mask construction, the source of heat is preferably provided by a heat lamp or heat bar which is generally designated 100 in FIG. 10. Heat generated by this heat lamp or heat bar is focused on at least the mask section and thereby causes the first section to be automatically curled or lifted away from workpiece first area 52″ generally in direction c.

Merely by way of example, a generally conventional heat lamp spaced a distance of approximately 5″ away from the mask will cause the desired amount of curling or lifting in a period of approximately 5 seconds. The relative spacing between the heat lamp and mask first section may generally vary between 2–8″ and the time span involved for heating may generally vary between approximately 2–8 seconds. Such heating under the foregoing parameters allows the mask to be quickly and expeditiously prepared. This capability is particularly desirable in production line applications such as is found in the automobile and appliance industries. The vinyl construction and black color for mask layer 20″ are particularly advantageous in that they enhance the desired curling or lifting action for first mask section 30″ during exposure thereof to elevated temperatures.

Following heating, the mask is allowed to cool for a short time interval. During cooling, the curling or lifting action continues briefly with mask first section 30″ then desirably and advantageously taking a set position. This set position is primarily attributable to the construction of mask layer 20″ from a vinyl material. As shown in FIG. 10, mask first section 30″ defines a generally arcuate angle with workpiece first area 52″ so that the mask first section diverges outwardly in a pocket-like defining manner from workpiece demarcation zone 56″. That is, following the above described heating and cooling steps, the entirety of workpiece first area 52″ is accessible for painting precisely from and along workpiece demarcation zone 56″ in a manner similar to that described previously with reference to FIG. 5. Thereafter, spray painting of workpiece first area 52″ and subsequent mask removal may be effected in a manner which has also been described. Also, the paint drape described with reference to FIGS. 8 and 9 may be satisfactorily used in conjunction with the FIG. 10 mask construction.

The concepts of the subject invention are considered to be readily applicable to all types of painting situations where a workpiece is to be painted along some predetermined, precise demarcation zone. The demarcation zone may be generally straight, curvilinear and/or define an enclosed area. A preferred use of the method is considered to be in conjunction with initial or original painting of vehicle bodies, for so-called refinish painting of both large and small areas on vehicle bodies and for repainting subsequent to repairs. The workpiece demarcation zone as used herein refers to any area of a workpiece which is to be separately painted, finished or refinished separately from adjacent vehicle areas. Again, however, the subject method is considered to be equally adapted to effective use in painting many other types and styles of workpieces or products.

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. A method for masking and painting a workpiece along some predetermined demarcation zone to accommodate spray painting of a workpiece first area, said method comprising the steps of:

providing a thin, flexible paint mask including a mask layer having opposed faces with one of said faces having an adhesive layer substantially covering the surface area thereof and with a thin liner removably covering said adhesive layer;

severing at least said liner in a manner forming a sever line therealong having the same longitudinal conformation as said demarcation zone and which divides said mask into at least two sections, one of said sections being adapted for association with said workpiece first area on one side of said demarcation zone and the other of said sections being adapted for association with a second workpiece area on the other side of said demarcation zone;

removing that portion of said liner associated with said mask other section for exposing a first portion of said adhesive layer;

placing said mask on said workpiece with said adhesive layer first portion adhesively engaging said workpiece second area while aligning said mask so that said sever line is substantially coextensive with said demarcation zone;

causing said mask one section to automatically lift away from said workpiece first area generally along said sever line and thereby expose said first area generally coextensive with said demarcation zone, said lifting being to such extent that said mask one section diverges outwardly of said workpiece first area from said demarcation zone at generally an acute angle;

directing a paint spray toward said workpiece first area from a direction generally normal thereto; and, removing said mask from association with said workpiece.

2. The method as defined in claim 1 wherein said step of severing comprises die cutting.

3. The method as defined in claim 1 wherein said step of severing comprises scoring.

4. The method as defined in claim 1 wherein said step of causing comprises applying a pressure force to the other of said mask faces along a pressure zone disposed along said mask other section adjacent to and coextensive with said sever line.

5. The method as defined in claim 4 wherein said step of applying is performed by using a tool having a thin pressure applying edge, said step of applying including pressing said tool against said mask at said pressure zone while moving said tool longitudinally along said pressure zone.

6. The method as defined in claim 1 wherein said step of causing comprises heating at least said mask one section and thereafter allowing said one section to cool so as to assume a set position.

7. The method as defined in claim 6 wherein said step of heating comprises exposing for some predetermined period of time at least said mask one section to a heat type lamp located in predetermined heating proximity therewith.

8. The method as defined in claim 6 wherein said step of providing includes constructing said mask layer from vinyl material which is black in color.

9. The method as defined in claim 1 further including the step of installing a paint drape on said mask other section between said steps of removing and placing, said step of installing including positioning said drape on said adhesive layer first portion so that a side edge of said drape is in a spaced apart generally parallel relationship with said sever line and with another side edge of said drape spaced outwardly of said mask other section in a direction generally opposite to said mask one section.

10. The method as defined in claim 9 wherein said step of installing is performed simultaneous with said step of removing.

11. An improved method for masking a workpiece to facilitate spray painting of a workpiece first area along a desired demarcation zone extending between said first area and workpiece second area wherein a thin mask comprised of a mask layer having an adhesive backing on one face thereof and a removable liner covering said adhesive backing is adhesively secured to said workpiece second area for masking it during subsequent spray painting of said workpiece first area, said improvement comprising:

severing at least said liner in a manner defining a sever line having the same longitudinal conformation desired for said demarcation zone and which divides said mask into at least two distinct sections, one of said sections adapted to be associated with said workpiece first area and the other of said sections adapted to be associated with said workpiece second area;

stripping away that portion of said liner associated with said mask other section for exposing the adhesive backing thereunder;

adhesively securing said mask other section by means of the exposed adhesive backing to said workpiece second area so that said sever line is in a substantially mating relationship with said demarcation zone and said mask one section extends from said demarcation zone over an area of said workpiece first area;

causing said mask one section to automatically lift away from said workpiece first area generally along said sever line and thereby expose said first area generally coextensive with said demarcation zone, said lifting being to such extent that said mask one section diverges outwardly of said workpiece first area from said demarcation zone at generally an acute angle.

12. The improvement as defined in claim 11 wherein said step of severing comprises scoring.

13. The improvement as defined in claim 11 wherein said step of severing comprises die cutting.

14. The method as defined in claim 11 wherein said step of causing comprises applying a pressure force to the other face of said mask along a narrow pressure zone disposed along said mask other section adjacent to and coextensive with said sever line.

15. The method as defined in claim 14 wherein said step of applying is performed by using a tool having a thin pressure applying edge, said step of applying including pressing said tool against said mask at said pressure zone while moving said tool longitudinally along said pressure zone.

16. The method as defined in claim 11 wherein said step of causing comprises exposing at least said mask one section to elevated temperatures for a predetermined period of time and allowing said one section to thereafter cool to assume a set position.

17. The improvement as defined in claim 16 including the step of constructing said mask layer from a vinyl material which is black in color and said step of exposing comprises placing a heat type lamp and at least said mask first section in predetermined heating proximity with each other for a predetermined period of time.

18. The improvement as defined in claim 11 wherein said step of severing is performed in a manner such that said mask first section has a width of approximately ¼".

19. The improvement as defined in claim 11 further including the steps of directing a paint spray toward said workpiece first area in a direction generally normal thereto following said step of causing and thereafter removing said mask from association with said workpiece.

20. The improvement as defined in claim 11 further including the step of installing a paint drape on said mask other section between said steps of stripping away and adhesively securing, said step of installing including positioning said drape on the exposed adhesive of said mask other section in a manner such that a side edge of said drape is in a spaced apart generally parallel relationship with said sever line.

21. The improvement as defined in claim 20 wherein said step of installing is performed simultaneous with said step of stripping away.

22. The method as defined in claim 20 wherein said step of positioning is performed so that the spacing between said sever line and said drape one side is at least approximately ¼".

* * * * *